United States Patent [19]

Halfpenny

[11] Patent Number: 4,625,808

[45] Date of Patent: Dec. 2, 1986

[54] DEVICE FOR COUPLING FIRE EXTINGUISHERS TO CLOSED-OFF COMPARTMENTS

[75] Inventor: Paul F. Halfpenny, Van Nuys, Calif.

[73] Assignee: Lockheed Corporation, Calabasas, Calif.

[21] Appl. No.: 673,708

[22] Filed: Nov. 21, 1984

[51] Int. Cl.[4] ..... A62C 11/00

[52] U.S. Cl. ..... 169/30; 169/70; 239/271

[58] Field of Search ..... 169/30, 52, 48, 70; 239/271, 272; 137/494, 508, 318; 222/5, 81, 83

[56] References Cited

U.S. PATENT DOCUMENTS

| | | | |
|---|---|---|---|
| 1,484,888 | 2/1924 | Johnson | 239/271 |
| 3,972,373 | 8/1976 | Nichols et al. | 169/62 |
| 4,124,077 | 11/1978 | Barge | 169/70 |
| 4,420,047 | 12/1983 | Bruensicke | 169/53 |

FOREIGN PATENT DOCUMENTS

| | | | |
|---|---|---|---|
| 637123 | 12/1978 | U.S.S.R. | 239/271 |

*Primary Examiner*—Jeffrey V. Nase
*Assistant Examiner*—L. E. Williams
*Attorney, Agent, or Firm*—Louis L. Dachs

[57] ABSTRACT

The invention is a device for coupling an outlet port of a fire extinguisher containing a source of pressurized fire suppression chemical to the interior of a closed-off compartment 12 having a pierceable wall 14. The device comprises a cylinder 22 having a moveable ram portion 66 adapted to pierce the wall 14 upon the cylinder receiving the pressurized fire suppression chemical. The cylinder 22 includes first and second ends 26, 32, the first end closed off by a first wall 28, the cylinder 22 further having an inlet port 30 in proximity to the first end 26. A piston 50 is moveably mounted within the cylinder 22, forming a closed-off chamber 56 within the cylinder. The piston 50 includes a piston rod 64 coupled to the ram portion. The piston 50 further includes passages 68, 70 coupling the chamber 56 to the exterior surface of the ram portion 66. A sealing disk 92 having a plurality of support rods 94 are moveably mounted through a plurality of holes 90 in the piston 50, with the length of the rods being greater than the thickness of the piston. The sealing disk 92 is adapted to seal the passage 68 when the piston 50 is in proximity to first end 26, and the rods 94 are adapted to contact a second wall 34 at a second end 32 prior to the piston coming into contact therewith causing the sealing disk 92 to uncover the passage 68. A flexible line 100 is adapted to couple the cylinder 50 to the outlet port 108 of a fire extinguisher 110.

7 Claims, 5 Drawing Figures

DEVICE FOR COUPLING FIRE EXTINGUISHERS TO CLOSED-OFF COMPARTMENTS

TECHNICAL FIELD

The invention relates to the field of fire-fighting equipment and, in particular, to a fire suppression system for use on aircraft which can effectively suppress fires within inaccessible as well as accessible areas.

BACKGROUND INFORMATION

A great many methods and substances exist to fight fires. When dealing with fires aboard aircraft, buses, trains, etc., large amounts of water are generally not available and portable containers of fire suppression chemicals are carried. These containers are usually filled with $CO_2$ or Halon compounds (for example, bromochlorodifluoromethane or bromotrifluoromethane). Their effectiveness depends upon the type of fire which is to be suppressed. For example: water, $CO_2$, and some dry chemicals are effective on burning wood and paper fires (Class "A"). Halon compounds are suitable for use on fires caused by flammable fluids (Class "A" and Class "B"), and electrical origin fires (Class "C").

The instant invention is primarily concerned with extinguishers using fire suppression chemicals such as Halon compounds. For example, Halon compounds are the principal fire suppression chemicals used in aircraft jet engine nacelles, APU installations, and selected cargo compartments as well as other designated high-fire-risk areas. Unfortunately, due to the high cost and weight of fixed suppression system installations, there are numerous cargo compartments and other inaccessible areas of the aircraft which are not so equipped.

In those areas which are accessible, such as the cabin proper, lavatories, and galleys, etc., fire protection depends upon the use of small, limited-capacity, hand-held extinguishers. An improvement to the hand-held-type extinguisher is disclosed in Applicant's U.S. Pat. No. 4,420,047, "Stowable Fire Suppression System for Aircraft Cabins and the Like". Here, a portable cart containing a tank filled with foam generating chemical is connectable to the aircraft's water supply system to provide fire suppressing foam. Thus, the limited capacity problem is solved.

For the aforementioned inaccessible compartments and areas, it would be very desirable to have the capability of "flooding" them with Halon compounds, thereby providing the most effective fire suppression available. Tackling this problem is U.S. Pat. No. 3,972,373, "Fire Extinguisher System for a Vehicle" by K. B. Nichols, et al. Nichols, et al. disclose a system wherein a hand-held fire extinguisher stored within the passenger compartment of a motor home can be connected from the exterior thereof to a manifold within the engine compartment to fight a fire therein. Such a system is unsuitable for use on an aircraft inflight since the fire extinguisher is connected to the engine compartment from an external connection and not from within the passenger compartment. Additionally, there is no disclosure of a long-term storage fluid isolation system, and means to precisely regulate the delivery of the fire suppression chemical, both of which are highly desirable.

Also of interest is U.S. patent application Ser. No. 665,406, Fire Suppression System For an Aircraft, by W. A. Bruensicke, herein incorporated by reference.

This fire suppression system includes a plurality of ducts coupling a plurality of subcompartments to the passage compartment. Each duct has first and second ends with the first end terminating in a first disconnect valve half accessible from the main cabin compartment. The second ends of the ducts terminate in nozzle assemblies within the subcompartment adapted to discharge the fire suppression chemical therein.

A portable unit having a tank filled with a fire suppression chemical is provided which is moveable within the main compartment. This unit has a length of flexible hose coupled to the tank and terminates in a nozzle assembly to which is mounted a second disconnect valve half, connectable to the first disconnect valve half attached to the ducts. In addition, an actuation means incorporated in the nozzle assembly provides flow rate control.

Thus, when a fire in a subcompartment occurs, the portable unit is moved to the location of the first disconnect valve half of the duct connected to that subcompartment, wherein the second disconnect valve half is coupled to the first half so that pressurized fire suppression chemical can be injected into the subcompartment.

One of the outstanding features of this system is that fires within accessible subcompartments, such as lavatories, can be reached without opening a door. This is a significant advantage when in confined spaces such as found on aircraft. The typical approach in a building wherein firemen use axes to break through walls, doors, and ceilings to gain access to the fire, creates serious problems on an aircraft. The most significant is that upon opening or breaking through the wall, the cabin will be immediately filled with smoke, causing severe discomfort and sometimes panic among the passengers. In one actual flight, many passengers were overcome by fumes and died. Thus, being able to reach a fire without opening a door or access panel is a significant advantage.

While this system provides a method for reaching both accessible and inaccessible areas on board the aircraft, it does require that specialized ducting be installed therein. This adds weight and, of course, costs in manufacturing the aircraft.

Therefore, it is a primary object of the subject invention to provide a fire suppression system, wherein both accessible and inaccessible compartments aboard an aircraft can be provided with effective fire suppression chemicals.

It is another object of the subject invention to provide a fire suppression system that can provide fire suppression chemicals to both accessible and inaccessible compartments using a single source of fire suppression chemical.

It is a further object of the subject invention to provide a portable fire suppression system which can be moved throughout the main compartment of the aircraft to fight localized fires therein, as well as those in inaccessible areas above and below the main compartment.

It is a still further object of the subject invention to provide a fire suppression system that can provide fire suppression chemicals to both accessible and inaccessible compartments using a single source of fire suppression chemical and which does not require the incorporation of dedicated ducting within the aircraft.

DISCLOSURE OF INVENTION

The invention is a device for coupling an outlet port of a fire extinguisher containing a source of pressurized fire suppression chemical to the interior of a closed-off compartment having a pierceable wall. The device comprises an actuation means having a moveable ram adapted to pierce the wall upon the actuation means receiving the pressurized fire suppression chemical. The actuation means includes a cylinder having first and second ends, the first end closed off by a first wall. An inlet port is connected to the cylinder in proximity to the first end. A piston is moveably mounted within the cylinder, forming a closed-off chamber therewithin. The piston includes a piston rod coupled to the ram.

Flow-control means are coupled to the actuation means and is adapted to deliver the fire suppression chemical to the interior of the compartment after the ram has pierced the wall. The flow-control means includes the piston, further including a passage means coupling the chamber to the exterior surface of the ram. Valve means are mounted to the piston and adapted to seal off the passage means from the chamber when the piston is in the first position and to couple the passage means thereto when the piston is in the second position. The valve means preferably comprises the piston having a plurality of holes extending therethrough. A sealing disk having a plurality of support rods are moveably mounted through the plurality of holes, with the length of the rods being greater than the thickness of the piston. The sealing disk is adapted to seal the passage means when the piston is in the first position and the rods are adapted to contact the second wall prior to the piston reaching the second position causing the sealing disk to uncover the passage means.

The device also includes coupling means adapted to couple the actuation means to the output port of the fire extinguisher. The coupling means typically includes a flexible hose having first and second ends with the first end coupled to the inlet port of the cylinder and the second end couplable to the outlet port of the fire extinguisher.

The novel features which are believed to be characteristic to the invention, both as to its organization and method of operation, together with further objects and advantages thereof, will be better understood from the following description connected with the accompanying drawings in which a presently preferred embodiment on the invention is illustrated by way of examples. It is to be expressly understood, however, that the drawings are for purposes of illustration and description only and are not intended as a definition of the limits of the invention.

BRIEF DESCRIPTION OF THE DRAWINGS

Illustrated in FIG. 1 is a partial perspective view of the device coupled to a fire extinguisher positioned against a wall of a subcompartment to fight a fire there within.

Illustrated in FIG. 2 is a partial cross-sectional view of the device in the unactuated position.

Figure 2:
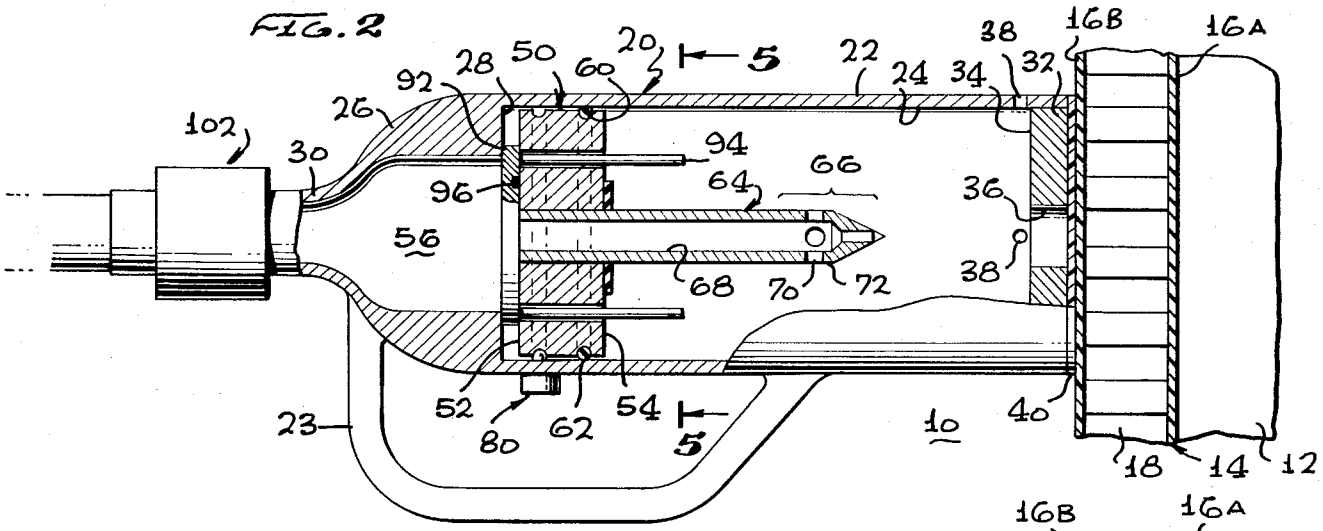
Figure 3:
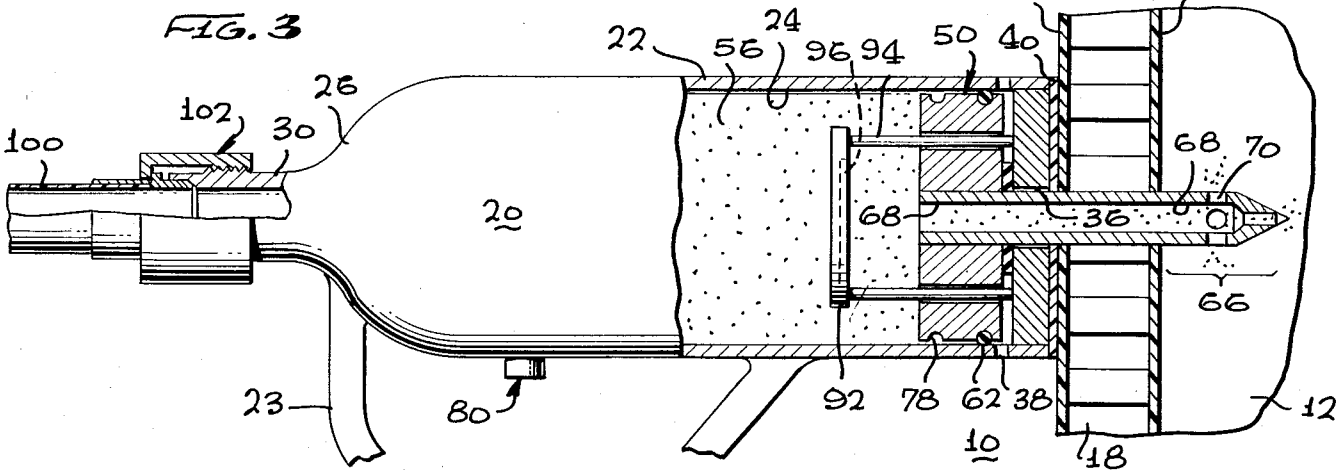

Illustrated in FIG. 3 is a partial cross-sectional view of the device illustrated in FIG. 2 in the actuated position.

Figure 4:
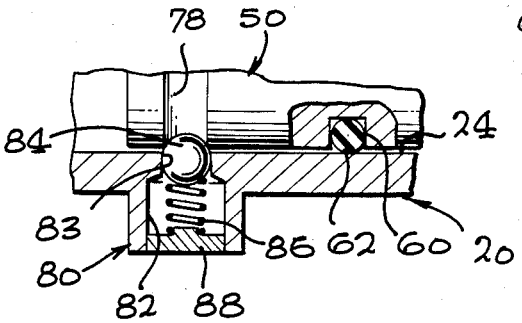

Illustrated in FIG. 4 is an enlarged partial view of a portion of the device shown in FIG. 2, particularly illustrating the piston hole detent assembly.

Figure 5:
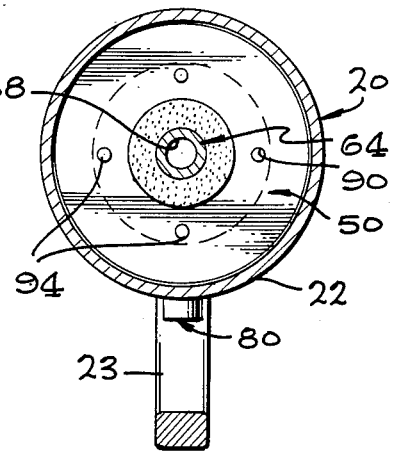

Illustrated in FIG. 5 is a cross-sectional view of the device shown in FIG. 2, taken along the line 5—5.

BEST MODE FOR CARRYING OUT THE INVENTION

Figure 1:
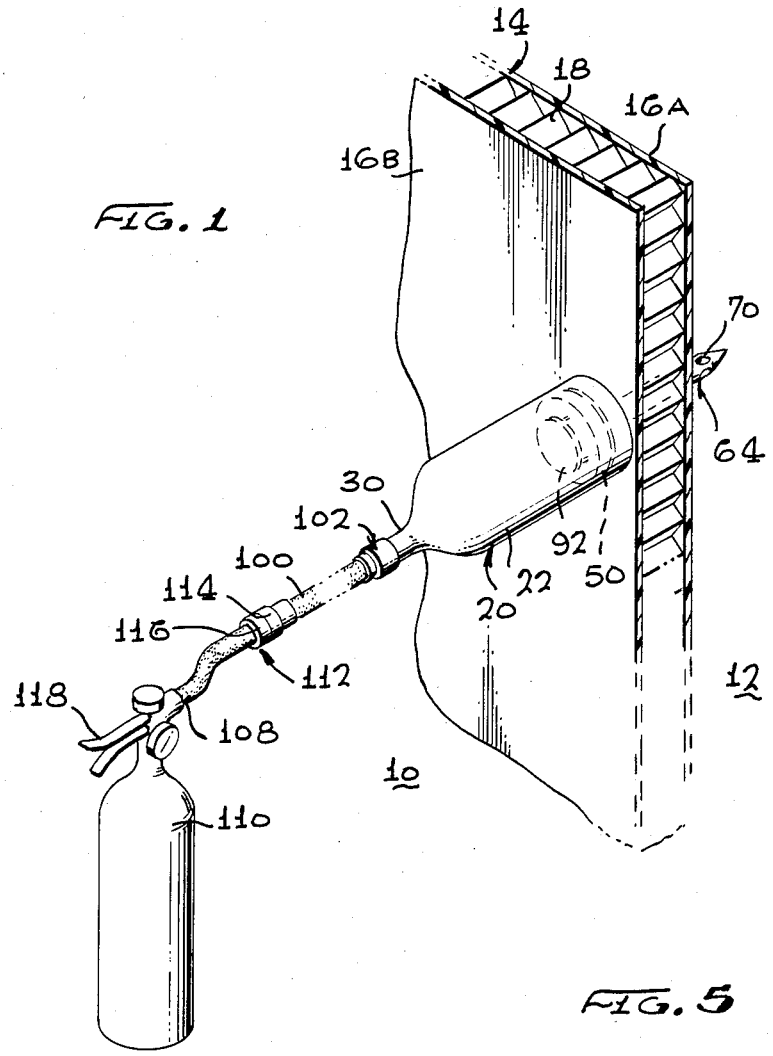

Referring to FIG. 1, a main compartment, for example, the passenger compartment of an aircraft, generally designated by numeral 10 is shown separated from a subcompartment 12, by means of a wall 14. The subcompartment 12 can be a lavatory, galley, storage bin, overhead compartment, as well as a below-floor compartment. The walls separating the various subcompartments are for the purpose of separating and are not normally adapted to carry any significant structural loads. Typically, the wall 14 is composed of face sheets 16A and 16B made of fiberglass or the like with a honeycomb core 18. The honeycomb core is usually made of fiberglass, Nomex, etc. Therefore, the wall can easily be pierced by any ram-type instrument. The floor of the aircraft is also generally of aluminum honeycomb construction. Balsa wood is sometimes used with aluminum face sheets. While being a load-carrying structural member, it is adapted to carry distributed loads so it, too, can be easily pierced by a ram.

The device 20 comprises a cylinder 22 having an external handle 23 and an internal bore 24. The first end 26 of the cylinder 22 is closed off by wall 28, having an inlet port 30 mounted therein. The second end 32 of the cylinder 22 is closed off by a second wall 34 having an aperture 36 therethrough. A plurality of vent ports 38 are located in the cylinder wall at the second end 32. Bonded to the exterior of the second wall 34 is a cover 40 sealing off the aperture 36. The purpose of the vent ports 38 and cover 40 will be subsequently discussed.

Moveably mounted within the cylinder 22 is a piston 50 having opposed principle surfaces 52 and 54, forming a variable volume, closed-off chamber 56. The piston incorporates a peripherical groove 60 having an O-ring seal 62 mounted therein which contacts bore 24. Coupled to piston 50 and extending out from surface 54 is a piston rod 64 terminating in a pointed ram portion 66. Preferably the ram portion 66 is made of a very hard material such as AISI 440 stainless steel. A passage 68 extends through the piston 50 and piston rod 64. A plurality of radially extending passages 70 couple the passage 68 to the external surface 72 of the ram portion 66.

Still referring to FIGS. 2 and 3 and, additionally, to FIG. 4, it can be seen that the piston 50 incorporates a second peripheral groove 78 which is engagable with a ball-detent assembly 80 (best sent in FIG. 4). The ball-detent assembly 80 comprises a bore 82 terminating in a ball seat 83. A ball 84 is moveably mounted therein and is biased toward the groove 78 in the piston 50 by coil spring 86 held in place by plug 88. With the piston 50 in the first position shown in FIG. 2 (in proximity to end 26 of the cylinder 22), the ball 84 engages the groove 78, thus, releasably holding the piston 50 in the first position.

Referring to FIGS. 2 and 3 and, additionally, to FIG. 5, it can be further seen that the piston 50 incorporates a plurality of holes 90. A sealing disk 92 includes a plurality of rods 94 which slidably engage the holes 90. The sealing disk 92 further includes a circular face seal 96 which, when the piston 50 is in the first position, seals off the passage 68 by contacting the surface 52.

Referring particularly to FIGS. 1–3, it can be seen that the inlet port 30 is coupled to a flexible line 100 by means of a conventional conical seal assembly 102. The opposite end of the line 100 is coupled to an outlet port 108 of a fire extinguisher 110. The coupling is typically accomplished by means of a quick-disconnect valve 112, with one half 114 coupled to the line 100 and the other half 116 coupled to the outlet port 108.

Thus, a fire in the subcompartment 12, can be fought wihout opening the subcompartment by the use of the device 20. The device 20 is attached to the fire extinguisher by coupling disconnect valve halves 114, 116 together. The device 20 is then placed against the wall 14 (best held in place by handle 23). Upon opening of the fire extinguisher 110 by activating trigger 118, fire suppression chemical (hereafter called the "chemical") will flow into the chamber 56 and drive the piston towards the wall 14. As the piston begins to move toward its second position in contact with the second wall 34, the restraining force of the ball-detent assembly 80 is overcome and the piston 50 accelerates as pressure increases in chamber 56. The velocity of the piston in conjunction with its mass provides inertial energy to assist in penetrating the wall 14.

At this point, the force on the sealing disk 92 keeps it in contact with the surface 52 of the piston 50 and, thus, seals 96 in contact therewith preventing the chemical from reaching the passage 68. As the piston moves, any air within the cylinder 22 between the piston 50 and the second wall 34 is forced out vent ports 38. But, as the rods 94 contact the second wall 34, the sealing disk 92 is prevented from moving further and, thus, surface 52 of the piston 50 separates from the seal 96, allowing the chemical to flow into passage 68 and out the passages 70.

In order to ensure that the ram portion 66 has completely pierced the wall prior to allowing flow into passage 68, the length of the piston rod 64, including ram portion 66, and the length of the rods 94 are selected so that any likely wall where the device would be used would have a thickness less than that which would allow the ram portion 66 to pierce it completely prior to the sealing disk being unseated. The previously mentioned cover 40 is incorporated so as to ensure that the ram portion 66 cannot accidentally extend out of the device through aperture 36 if it is dropped. While strong enough to absorb such an impact, the cover 40 is designed to be easily pierced when the cylinder is pressurized.

After the fire has been extinguished, the trigger 118 is released, cutting off the flow of chemical. The device 20 can be removed from the wall 14 by giving a strong pull on the handle 23. Thereafter, the piston 50 can be moved back to its first position engaged with the ball-detent assembly 80 by pushing it back with a rod-shaped instrument such as a pencil. Thereafter, it is ready to be used again.

In the previously mentioned patent application, Ser. No. 665,406, "Fire Suppression System" by W. A Bruensicke, the portable unit was coupled to the ducting by means of a disconnect valve. If such a disconnect valve were substituted for the disconnect valve 112, the portable unit therein could be used with the device 20. This would have the advantage of not requiring ducting coupling all the subcompartments to the passenger compartment—just those which have walls that are not easily piercable or are remote from the passenger compartment.

While the invention has been described with reference to a particular embodiment, it should be understood that the embodiment is merely illustrative as there are numerous variations and modifications which may be made by those skilled in the art. Thus, the invention is to be construed as being limited only by the spirit and scope of the appended claims.

Industrial Applicability

The fire suppression system has applicability to transportation vehicles and, in particular, aircraft and ships, as well as industrial plants where a combination of potential accessible and inaccessible fire areas exist.

I claim:

1. A device for coupling an outlet port of a fire extinguisher containing a source of pressurized fire suppression chemical to the interior of a closed off compartment having a pierceable wall, the device comprising:

a cylinder having first and second ends closed off by first and second walls, respectfully, said second wall having an aperture therethrough, said cylinder further having an inlet port in proximity to said first end;

a piston assembly comprising:

a piston movably mounted within said cylinder forming a closed off chamber within said cylinder, said piston movable from a first position in proximity to said first end to a second position in contact with said second wall;

a piston rod coupled at one end to said piston and at its opposite end terminating in a ram adapted to pierce the wall, said piston rod adapted to pass through said aperture as said piston moves from said first position to said second position;

passage means coupling said chamber to the exterior surface of said ram;

valve means comprising:

said piston having a plurality of holes extending therethrough; and a sealing disk having a plurality of support rods movably mounted through said plurality of said holes, the length of said rods being greater than the thickness of said piston, said sealing disk adapted to seal said passage means when said piston is in said first position and said rods adapted to contact said second wall prior to said piston reaching said second position causing said sealing disk to uncover said passage means.

2. The device as set forth in claim 1 further including detent means adapted to releasably hold said piston in said first position.

3. The device as set forth in claim 2 wherein said detent means comprises:

said piston having a circumferential groove; and a spring-biased ball detent mounted in said cylinder adapted to engage said groove when said piston is in said first position.

4. The device as set forth in claim 2 wherein said coupling means comprises a flexible hose having first and second ends, said first end coupled to said inlet port of said cylinder and said second end coupled to the outlet port of the fire extinguisher.

5. The device as set forth in claim 4 wherein said second end of said flexible hose terminates in a first half of a quick-disconnect valve and the outlet port of the fire extinguisher incorporates a second half of a disconnect valve.

6. The device as set forth in claim 5 further including said cylinder having at least one vent port located in proximity to said second end, such that upon movement of said piston from said first position to second position, air can be vented from said cylinder.

7. The device as set forth in claim 2 wherein the wall of the compartment has a specified thickness, the device comprising:

said piston rod, said ram, and said support rods having a sufficient length such that when said cylinder is placed against the wall and the fire suppression chemical flow initiated, said ram will have extended through the wall of the compartment to a point wherein said passage means is in communication with the interior of the compartment prior to said support rods contacting said second wall.

* * * * *